United States Patent [19]

Coleman

[11] 4,276,851

[45] Jul. 7, 1981

[54] UNDERWATER CRUISE DEVICE

[76] Inventor: Jess A. Coleman, Rte. 1, Box 29, Dunnellon, Fla. 32630

[21] Appl. No.: 65,648

[22] Filed: Aug. 10, 1979

[51] Int. Cl.[3] ..... B63G 8/00; B63B 1/00

[52] U.S. Cl. ..... 114/313; 114/315; 114/331; 114/334; 114/336; 114/338; 114/61; 114/66; 114/322

[58] Field of Search ..... 114/322, 61, 66, 49, 114/50, 51, 312, 313, 315, 324, 323, 325, 330, 331–333, 334, 335, 336, 337–338

[56] References Cited

U.S. PATENT DOCUMENTS

| | | | |
|---|---|---|---|
| 1,784,549 | 12/1930 | Shoemaker | 114/322 |
| 3,400,680 | 9/1968 | Taylor | 114/330 |
| 3,712,070 | 1/1973 | Macinnis | 114/331 X |

*Primary Examiner*—Douglas C. Butler
*Attorney, Agent, or Firm*—Stanley M. Miller

[57] ABSTRACT

An underwater cruise device is disclosed which is mounted to a vessel by a vertical telescoping boom. The device includes a diving chair mounted to the vertical boom which can be selectively submerged during diving operations or completely withdrawn from the water for long distance, surface cruising. A concave, transparent shell canopy is mounted to the diving chair, forming an enclosed upper cavity which can contain a breathable gas ambient to surround the head of the seated diver. Controls are provided on the diving chair to enable the submerged diver to control the extension of the vertical boom into the water and the propulsion and steering of the vessel itself. Radio and television communication with the surface can be provided so that the diver can monitor surface conditions while cruising in the submerged diving chair. In the preferred embodiment, the diving chair is a concave shell with a closed rearward side and an open forward side and the transparent shell canopy is hingidly mounted to the upper forward edge of the chair for selective sealable engagement therewith. When the diving chair is submerged, the resultant craft provides the diver with great control over his diving operation while seated within the breathable gas ambient of the diving chair, unencumbered by his face mask and scuba breathing apparatus. When the diving chair is drawn up to the surface, the resultant craft has a low drag contour for high speed surface cruising.

38 Claims, 19 Drawing Figures

SEC. 2-2'

FIG. 6c
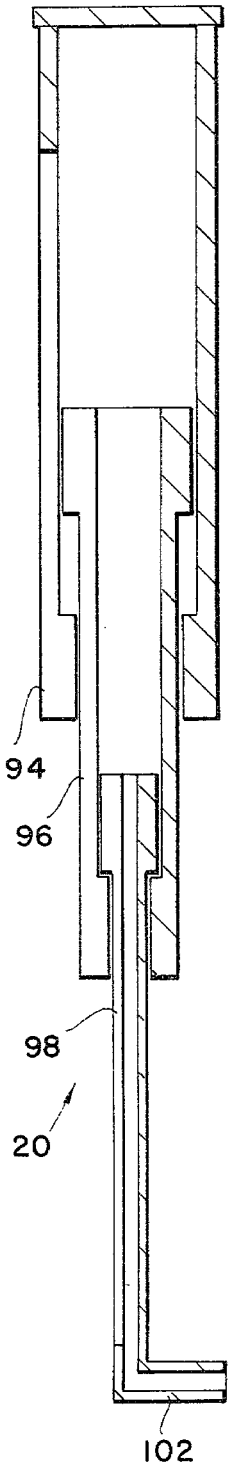
FIG. 6a
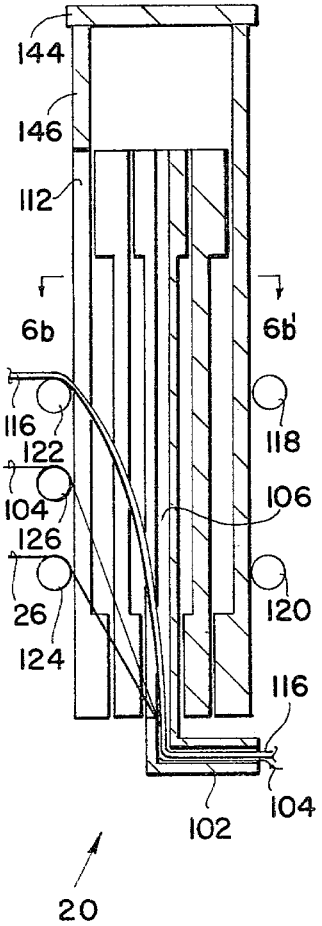
FIG. 6d
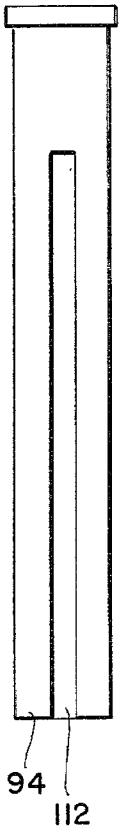
FIG. 6e
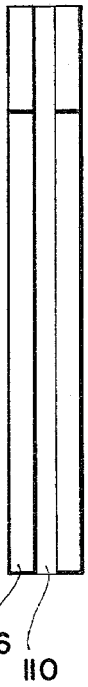
FIG. 6f
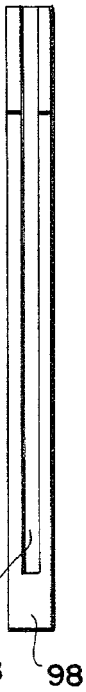
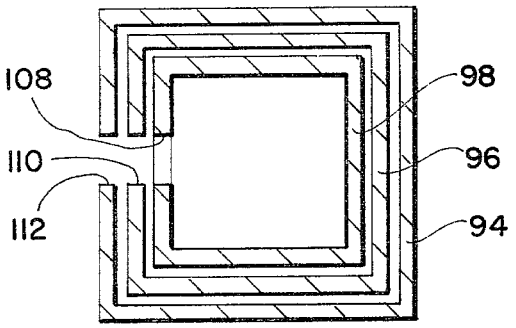
FIG. 6b
SEC. 6b - 6b'

FIG. 8a
NAVIGATION SYSTEM
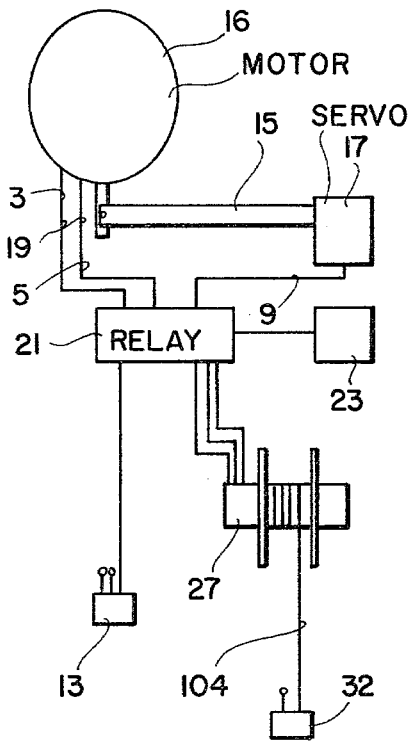
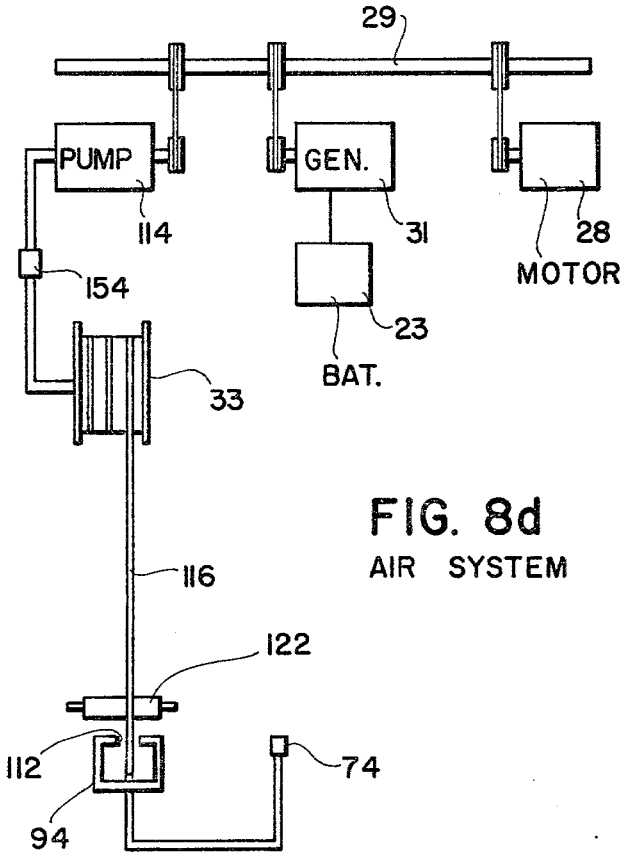
FIG. 8d
AIR SYSTEM
FIG. 8b
NAVIGATION CONTROL
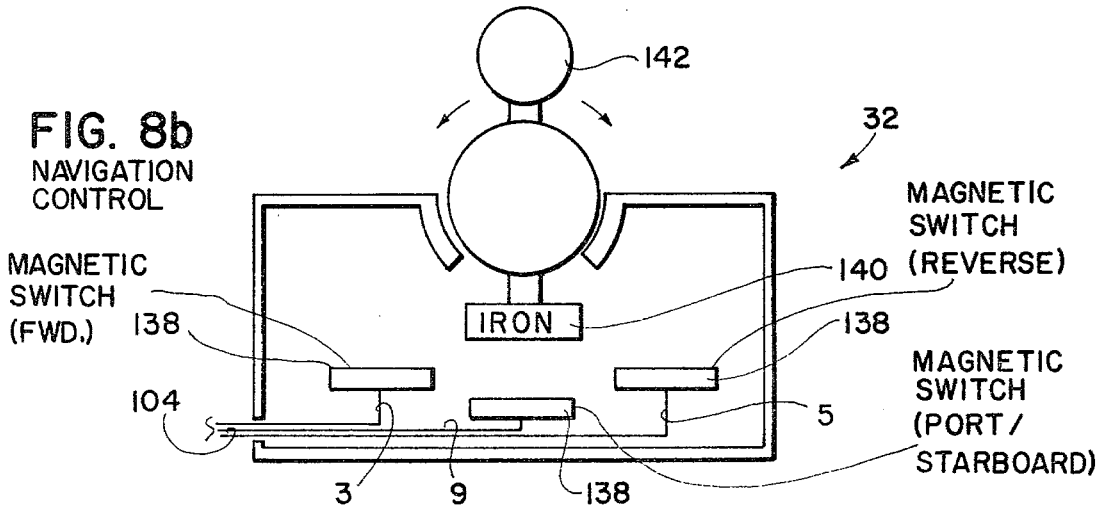

ELECTRICAL SYSTEM

UNDERWATER CRUISE DEVICE

FIELD OF THE INVENTION

The invention disclosed broadly relates to water vessels and more particularly relates to a surface vessel with an attached, submergeable diving chair.

BACKGROUND OF THE INVENTION

Modern sport and commercial diving has its roots in antiquity with the earliest referenced practice of diving occuring in the Iliad. Pearl and sponge diving and salvage operations have been engaged in since Greek and Roman times. Early divers were sometimes provided with devices for drawing air from above the water such as through a tube, one end of which would be carried in the mouth while the other end was made to float on the surface. In 17th century England, rudamentary diving bells were developed. When a container is immersed in water, with its opening pointing downward, the volume of air enclosed in it diminishes in proportion to its depth in the water, the air pressure being balanced by the pressure of the water at its own level. If, however, air is compressed in a container at a pressure slightly above the already existing pressure, the level of the water inside will drop until the air escapes from the lower rim of the vessel. This principle of the diving bell was applied in industry for laying bridge foundations. Greater mobility for the submerged diver has been provided in more recent times with the advent of the self-contained underwater breathing apparatus (scuba), wherein tanks of compressed air are worn on the diver's back and, when combined with a diving mask, a weighted belt and a means of propulsion, enabled men to swim and explore under water with greater freedom. Apparatus designed by J. Y. Costeau and E. A. Ghenan which provide a demand valve regulator for supplying air to the diver only on inhalation, have come into common usage.

The scuba diver, however, has a limited diving time of approximately one hour, the duration of which depends on the average depth of his dive, and this limits the distances over which he can explore while submerged. The prior art has attempted to take advantage of the freedom of scuba diving while, at the same time extending the exploration range while submerged, by providing various types of underwater cruising devices. The bathyscaph first constructed by Piccard and Cosyns in 1948, was a sealed steel cabin equipped with Plexiglas observation protholes, and was a self-contained submarine vessel equipped with its own means of propulsion. The principal application of a bathyscaph is for relatively deep diving at depth in excess of 1,000 feet. However most sport and commercial diving is done at depths of from 30 to 100 feet where there is no need for expensive, complex apparatus represented by the bathyscaph. The prior art has developed shallow immersion underwater cruise devices such as that disclosed in U.S. Pat. No. 3,400,680 which discloses a catamaran for underwater exploration. That patent describes a chair connected by a solid vertical pole to a suspension bridge mounted between a pair of pontoons of a catamaran vessel. In its upward position, the chair remains partially submerged in the water while the diver enters from the catamaran vessel. In its fully submerged position, the diver breathes from an air supply through a mouthpiece while carrying on his observations through a conventional skin diving face mask worn on his person. The chair can never be fully withdrawn from the water and therefor the vehicle cannot be readily transported by surface cruising from one diving station to another. The diving chair in that patent provides room for only a single occupant, which controverts the safety practice of two-man diving operations. In addition, since the diver seated in the diving chair described in that patent must wear a diving mask and air mouth-piece on his person, there is no relief from the pressure of the face mask or mouthpiece during the course of a lengthy exploration and no opportunity for oral communication with another diver. Another drawback is exposure of the diver's person to floating and suspended debris in the water while engaging in an underwater cruise operation. Furthermore, that patent describes a selective buoyancy technique employing an air ballast, to raise the diving chair, which requires the interruption of the breathing air supply, while the ballast tanks are filled for the ascent of the chair. The prior art has failed to provide an underwater cruise device suitable for sport and commercial diving which provides protection, convenience and long exploration range to the scuba diver.

OBJECTS OF THE INVENTION

It is therefor an object of the invention to provide an improved underwater cruise device.

It is another object of the invention to provide an improved underwater cruise device which provides a greater degree of protection to the diver.

It is yet another object of the invention to provide an underwater cruise device which can be completely withdrawn from the water to enable easy transportion from one diving station to another.

It is still a further object of the invention to provide an improved underwater cruise device which enables more than one diver to explore, in a seated position, a greater range of submarine terrain.

It is still a further object of the invention to provide an improved underwater cruise device which has a breathable gas ambient for one or more divers.

It is yet a further object of the invention to provide an improved underwater cruise device which has improved control by the submerged diver of the depth of immersion of the device and the surface navigation of the vessel.

SUMMARY OF THE INVENTION

These and other objects are accomplished by an underwater cruise device which is mounted to a vessel by means of a vertical telescoping boom. The device includes a diving chair mounted to the vertical boom which can be selectively submerged during diving operations or completely withdrawn from the water for long distance, surface cruising. A concave, transparent shell canopy is mounted to the diving chair, forming an enclosed upper cavity which can contain a breathable gas ambient to surround the head of the seated diver. Controls are provided on the diving chair to enable the submerged diver to control the extension of the vertical boom into the water and the propulsion and steering of the vessel itself. Radio and television communication with the surface can be provided so that the diver can monitor surface conditions while cruising in the submerged diving chair. In the preferred embodiment, the diving chair is a concave shell with a closed rearward side and an open forward side and the transparent shell canopy is hingidly mounted to the upper forward edge of the chair for selective sealable engagement therewith. When the diving chair is submerged, the resultant craft provides the diver with great control over his diving operation while seated within the breathable gas ambient of the diving chair, unencumbered by his face mask and scuba breathing apparatus. When the diving chair is drawn up to the surface, the resultant craft has a low drag contour for high speed surface cruising.

DESCRIPTION OF THE FIGURES

These and other objects, features and advantages of the invention will be more fully appreciated with reference to the accompanying figures.

FIG. 6*a* is a side, break-away view of the telescoping boom in its retracted position.

FIG. 6*b* is a cross-sectional view along the section lines 6*b*—6*b'* of FIG. 6*a*.

FIG. 6*c* is a side, break-away view showing the telescoping boom in its extended position.

FIGS. 6*d*, 6*e*, and 6*f* show rearward views of the outer beam 94, middle beam 96, and inner beam 98, respectively, of the telescoping boom.

FIG. 8*a* is a schematic diagram of the navigation system for the craft.

FIG. 8*b* is a side view of the navigation control mounted onboard the diving chair.

FIG. 8*d* is a schematic diagram of the air delivery and electrical charging systems of the craft.

DISCUSSION OF THE PREFERRED EMBODIMENT

An underwater cruise device is disclosed which is mounted to a vessel by means of a vertical telescoping boom. The device includes a diving chair mounted to the vertical boom which can be selectively submerged during diving operations or completely withdrawn from the water for long distance, surface cruising. A concave, transparent shell canopy is mounted to the diving chair, forming an enclosed upper cavity which can contain a breathable gas ambient to surround the head of the seated diver. Controls are provided on the diving chair to enable the submerged diver to control the extension of the vertical boom into the water and the propulsion and steering of the vessel itself. Radio and television communication with the surface can be provided so that the diver can monitor surface conditions while cruising in the submerged diving chair. In the preferred embodiment, the diving chair is a concave shell with a closed rearward side and an open forward side and the transparent shell canopy is hingidly mounted to the upper forward edge of the chair for selective sealable engagement therewith. When the diving chair is submerged, the resultant craft provides the diver with great control over his diving operation while seated within the breathable gas ambient of the diving chair, unencumbered by his face mask and scuba breathing apparatus. When the diving chair is drawn up to the surface, the resultant craft has a low drag contour for high speed surface cruising.

Figure 1:
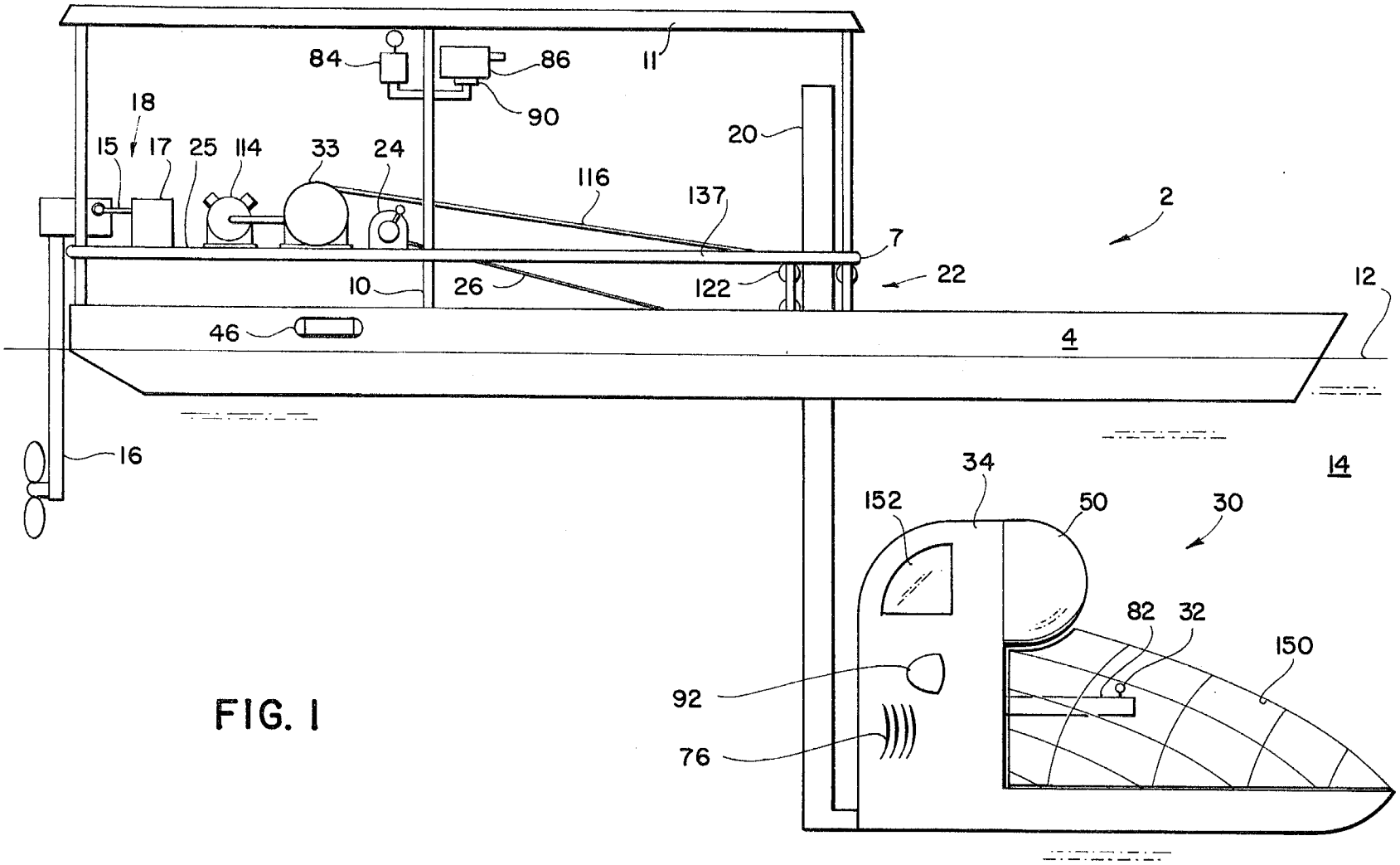
FIG. 1 is an overall side view of the surface vessel and diving chair in its submerged position, showing the shark cage 150 in place.
Figure 2:
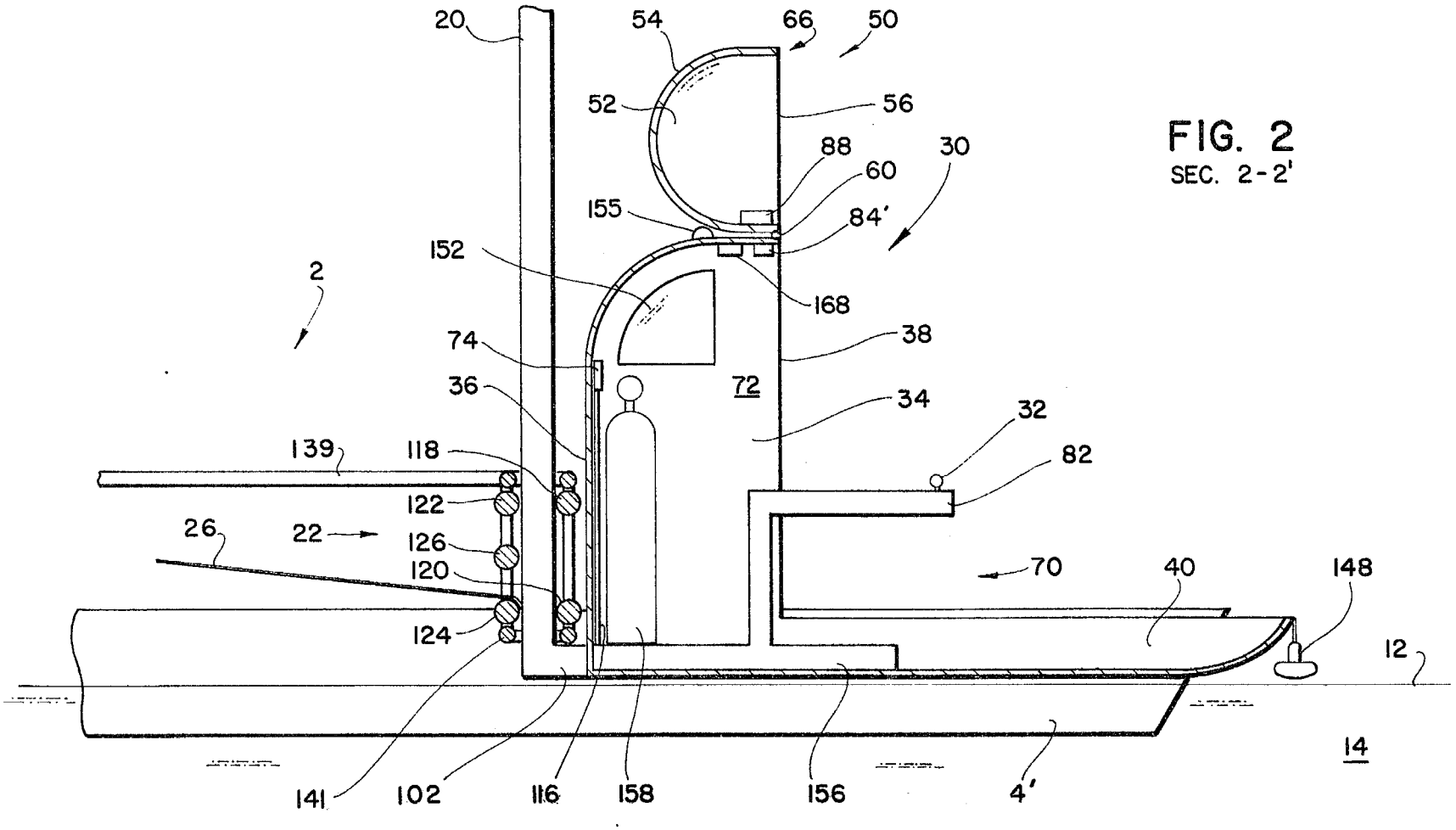
FIG. 2 is a side, cross-sectional view along the section line 2—2' of FIG. 4, of the diving chair in its upward position, withdrawn from the water. The chair is shown with the shark cage 150 removed and the hinged canopy 52 in its upward position.
Figure 3:
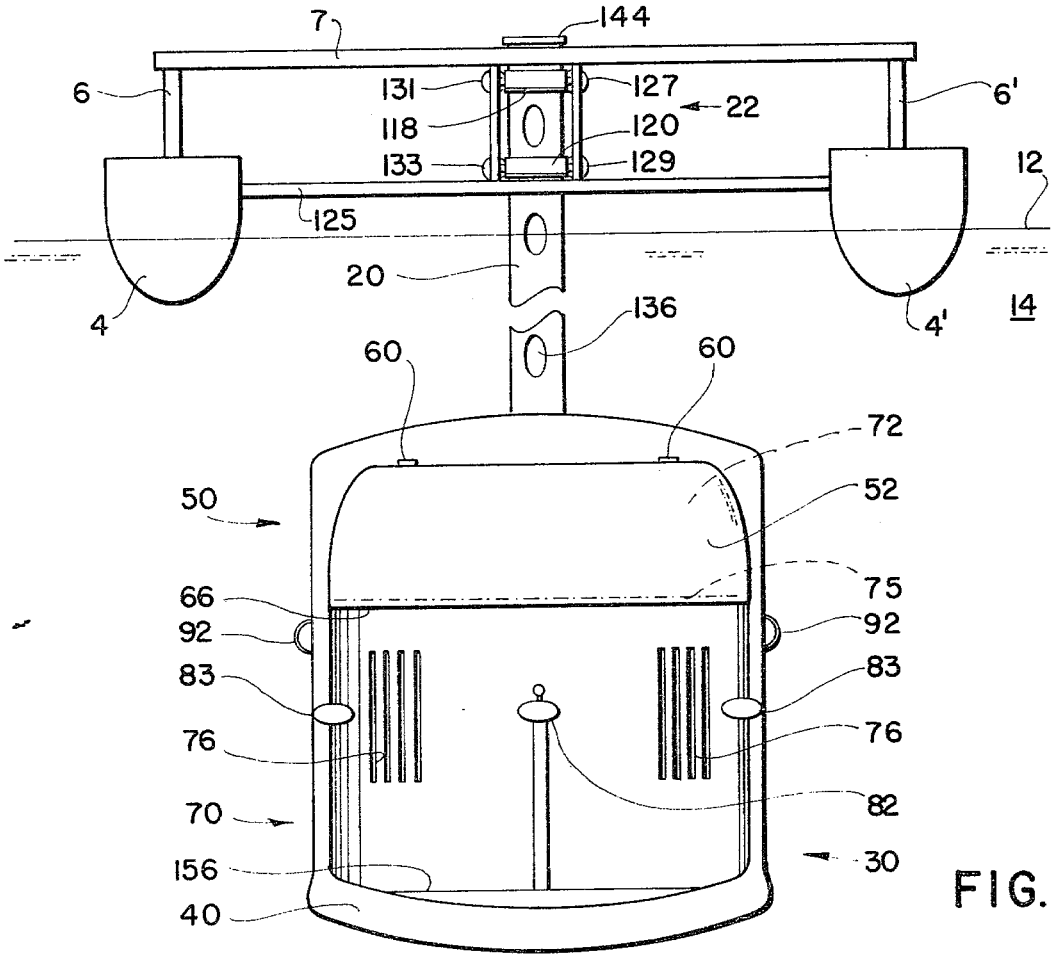
FIG. 3 is a front view of the surface vessel and diving chair in its submerged position.
Figure 4:
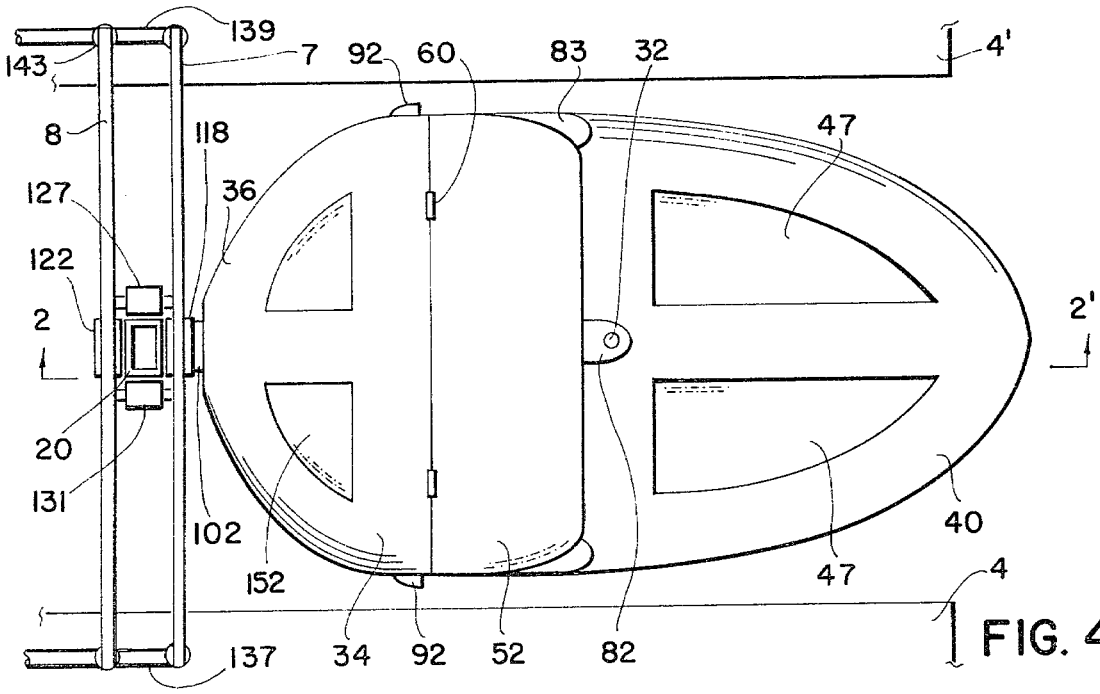
FIG. 4 is a top view of the diving chair in its upward position with hinged canopy 52 in its lower position.
Figure 5A:
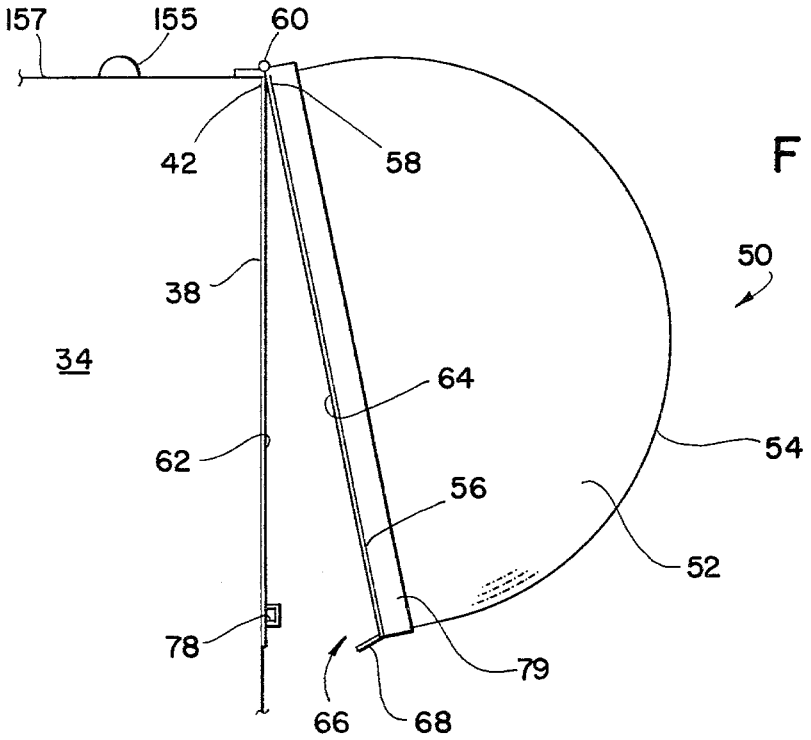
FIG. 5*a* is a side view of the preferred embodiment for the canopy.
Figure 5B:
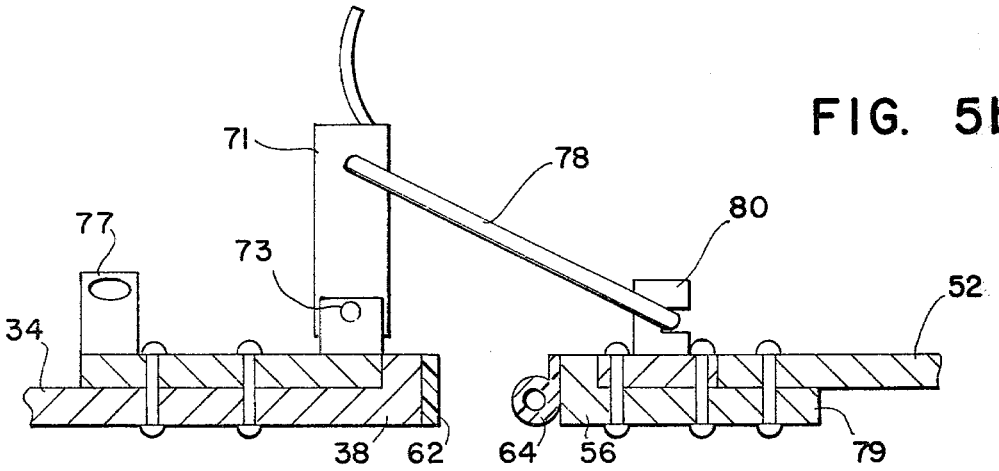
FIG. 5*b* and 5*c* illustrate the latching mechanism for the canopy of FIG. 5*a*, in its open and closed positions, respectively.
Figure 5C:
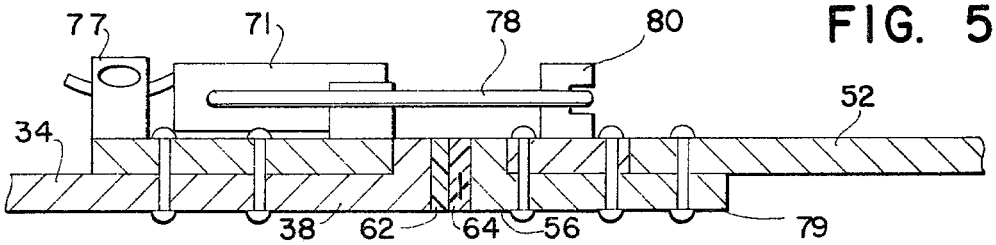

The underwater cruise device is shown in a side view in FIG. 1 wherein a vessel 2 which, in the preferred embodiment is a catamaran, has pontoons 4 and 4' floating on the surface 12 of a body of water 14 as shown to better advantage in the front view of FIG. 3. A vertical, telescoping boom 20 shown in detail in FIGS. 6*a*–6*f*, is slidably mounted by means of the mounting assembly shown in FIG. 7 to the pontoons 4 and 4' of the vessel 2 by means of the upper crossbars 7 and 8 and the lower crossbars 119 and 141. A boom driving means 24, such as a rotary winch, is mounted on the platform 25 supported by the pontoons 4 and 4' and is connected by means of the cable 26 to the boom 20, for selectively extending the boom 20 vertically into the water 14. A diving chair 30 shown shown to better advantage in FIGS. 2, 3 and 4, is mounted to the vertical boom 20 for selective submersion of a diver seated thereon, in response to the operation by the diver of a control console 32 mounted on an arm rest 82 on the chair 30. The control console 32 is operatively connected to the winch 24, by means of a switch 37 whose circuit is shown in FIG. 8*c*.

Figure 9:
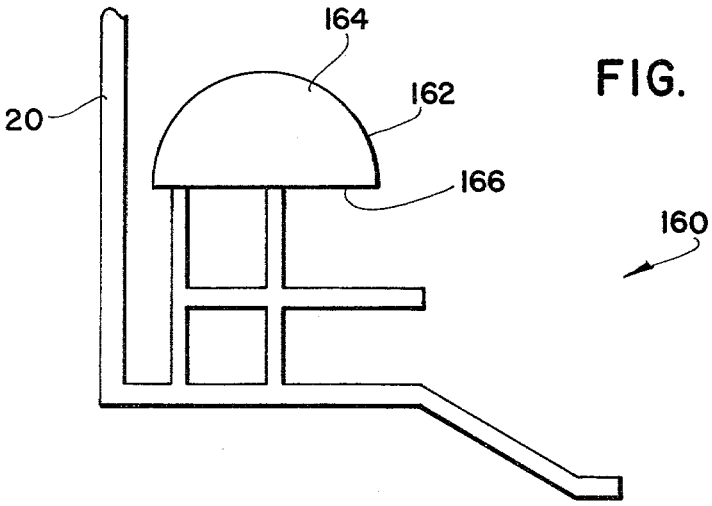
FIG. 9 is a view of an alternate embodiment for the diving chair.

Two embodiments of the diving chair are described, the preferred embodiment is shown in FIGS. 1, 2, 3, 4 and 5*a*–*c* and an alternate embodiment is shown in FIG. 9. With respect to the preferred embodiment shown in FIGS. 1 through 5*a*–*c*, the chair 30 comprises a concave shell 34 with a closed rearward side 36 and an open forward side 38. The open forward side 38 has a lower interior surface 40 for supporting the seated diver and an upper peripheral edge 42. The concave canopy 50 comprises a concave, transparent shell 52 with a closed forward side 54 and an open rearward side 56, having an upper peripheral edge 58 which is hingeably mounted by means of the hinges 60 to the upper peripheral edge 52 of the concave shell 34 for the chair 30. A resilient seal strip 62 mounted to the edge 38 of the chair shell 34 shown in FIG. 5*b*, sealably engages a resilient seal 64 mounted on the edge 56 of the canopy shell 52 when the canopy 50 is in its lowered, closed position as is shown in FIG. 1. A lower peripheral edge 66 of the canopy 50 is spaced above the lower interior surface 40 of the chair 30, forming a diver access opening 70. The canopy 50 and chair shell 34 form an enclosed upper cavity 72 which contains a breathable gas ambient such as air above the driver access opening 70, surrounding the head of the seated diver. In this manner, the diver can breathe the breathable gas ambient while seated in the submerged chair.

A source of breathable gas such as the outlet 74 of the air hose 116 connected to an air compressor 114 on the platform 25 of the vessel 2, is mounted in proximity to the enclosed upper cavity 72. The physical principle for the operation of the cavity 72 is similar to that for a diving bell. When a container is submersed in water, with its opening pointing downward, the volume of air enclosed in it diminishes in proportion to its depth in the water, the air pressure being balanced by the pressure of the water at its own level. For example, at 33 feet, when the pressure of the water is double the atmospheric pressure, the volume of air in the container is reduced by one-half. However, by supplying compressed air, as for example from the source 74 into the cavity 72 as shown in FIG. 2, compressing the air in the cavity to a pressure slightly above the pressure already existing, the level 75 of water inside will drop until the air escapes from the lower peripheral edge 68.

The diving chair 30 may have its rearward side 36 perforated with perforations 76 through the lower portion thereof to reduce fluid drag forces when the chair is immersed in the water 14. The chair 30 may further include the latch shown in FIGS. 5*b* and 5*c*, having a hasp portion 78 and lever 71 pivotally mounted at 73 mounted to the chair shell 34 and a post portion 80 mounted to the canopy shell 52 and canopy band 79 to secure the canopy 52 against the chair shell 34 and provide the sealable engagement of the seals 62 and 64, respectively. The lever 71 may be locked in its closed position of FIG. 5*c* by means of the lock post 77. As may be seen in FIGS. 2, 3 and 4, the chair 30 further includes the central arm rest 82 which is mounted to the chair shell 34 for supporting the control console 32. FIGS. 3 and 4 also show the side arm rests 83 mounted to the sides of the chair shell 34.

An additional feature which may be included in the diving chair 30 is radio speaker and microphone 84', shown in FIGS. 2 and 8*c*, which may be mounted to the interior of the chair shell 34 and connected to the radio transceiver 84 on the vessel 2, to enable communication with other radio transceivers located above the water's surface 12. In addition, the television camera 86 may be mounted on the vessel as is shown in FIG. 1. A television monitor 88 may be mounted within the cavity 72 of the chair 30, as shown in FIG. 2, and operatively connected to the camera 86 as shown in FIG. 8*c*. A camera rotor 90 may be mounted to the camera 86 and connected to the control console 32, for controlling the orientation of the camera 86. The chair 30 can further include the diving lights 92 which are mounted to the chair shell 34, as shown in FIG. 1. A ballast weight 156 may be mounted to the chair bottom 40, to enable the rapid descent of the diving chair when the winch 24 is released. A reserve tank of breathable gas 158 may be mounted inside the chair 30 on the back wall 36 near the upper cavity 72, to save the diver during emergency situations. A resilient bumper 155 may be mounted to the top 157 of the chair shell 34, to support the canopy 50 in its open position. An interior light 168 may be provided on the top portion 157 of the chair shell 34.

As may be seen in FIGS. 2 and 4, the closed rearward side 36 of the chair shell 34 may include rear windows 152 mounted in the upper portion thereof. As may be seen in FIG. 4, the bottom 40 of the diving chair 30 may have windows 47 therein. An anchor 148 may be mounted to the bottom portion 40 of the chair 30, as shown in FIG. 2. A shark net 150 may be mounted to the chair 30 as is shown in FIG. 1.

The vertical boom 20, which is shown in greater detail in FIGS. 6*a*–6*f*, comprises a telescoping plurality of nested, U-shaped beams 94, 96 and 98. Any number of beams may be employed. The Figures show 3 nested beams. A 33 foot depth below the surface of the water can be achieved for the diving chair by employing one, 9-foot long outer beam 94, three 7-foot long intermediate beams 96 and one 7-foot long innermost beam 98. The outermost beam 94 slidably engages the boom mounting assembly 22 shown in FIG. 7 on the vessel 2. The innermost one of the beams 98 is mounted to the chair shell 34 on the back side 36 thereof, wherein a horizontal extension 102 of the innermost beam 98 is mounted to the base of the rear of the diving chair, as shown in FIG. 2. The bottom 102 of the innermost beam 98 is connected by means of the cable 26 to the winch 24 on the vessel 2.

The electric winch 24 on the vessel 2 is connected by means of the control wires 104 to the control console 32 mounted on the arm 82 of the chair 30. The control wires 104 and the cable 26 pass axially through the innermost beam 98 as is seen in FIG. 6*a*, the bottom portion 102 thereof up to a level of the rollers 124 and 126, respectively, of the mounting assembly 22, shown to better advantage in FIG. 7. Control wires 104 and cable 26 pass transversely through the open slot portions 108, 110 and 112 of the U-shape for each of the beams 98, 96 and 94, respectively, at the level where the outer beam 94 contacts the rollers 124 and 126.

The vessel 2 has propulsion apparatus 16 and steering apparatus 18 mounted thereon. A schematic diagram of the remote control elements for the steering and propulsion apparatus is shown in FIG. 8*a*. The control console 32 on the chair 30, as shown in FIG. 86, is connected to the propulsion apparatus 16 and steering apparatus 18 on the vessel 2 by means of navigation control wires 3, 5, and 9 in the cable 104, which pass axially through the innermost beam 98 from the bottom 102 thereof and pass transversely through the open slot portions 108, 110 and 112 of the beams and pass over the roller 126 at the mounting assembly 22. FIG. 8*b* illustrates the magnetically actuated electric switches 138 connected to the control wires 3, 5, and 9. Switches 138 are hermetically sealed and are actuated by the proximity of a ferromagnetic material 140, such as iron, mounted to a joy-stick type operating switch handle 142 in the console 32. Moving the handle 142 forward (to the right in FIG. 8*b*) will actuate the magnetic switch 138 connected to wire 3, signaling the propulsion motor 16 to move the vessel forward. Moving the handle 142 in the opposite direction will produce a signal in wire 5, causing motor 16 to move the vessel backward. Similar port or starboard movement of the handle 142 in the perpendicular direction will actuate the servo 17 over wire 9 to cause link 15 to steer the vessel in the corresponding direction. Cable 104 through which wires 3, 5, and 9 pass, is kept in tension by means of the spring-loaded reel 27 about which cable 104 is wound. Connection from reel 27 to the motor 16 and servo 17 is made through the relay box 21, powered by battery 23. Deck controls 13 may be used to control navigation from onboard the surface vessel 2, if desired.

The air hose 116 connected to the canopy cavity 72, is connected to the air compressor 114 on the surface vessel 2, driven by motor 28. The battery 23 is charged by generator 31 which is also driven by motor 28, via shaft 29. The schematic diagram of an air delivery system is shown in FIG. 8*d*. The air hose 116 passes axially through the innermost beam 98 from the bottom 102 thereof and passes transversely through the open slotted portion 108, 110 and 112 of the beams, and passes over the roller 122 of the mounting assembly 22. The air hose 116 is kept in tension by being wound onto the spring-loaded reel 33.

Figure 7:
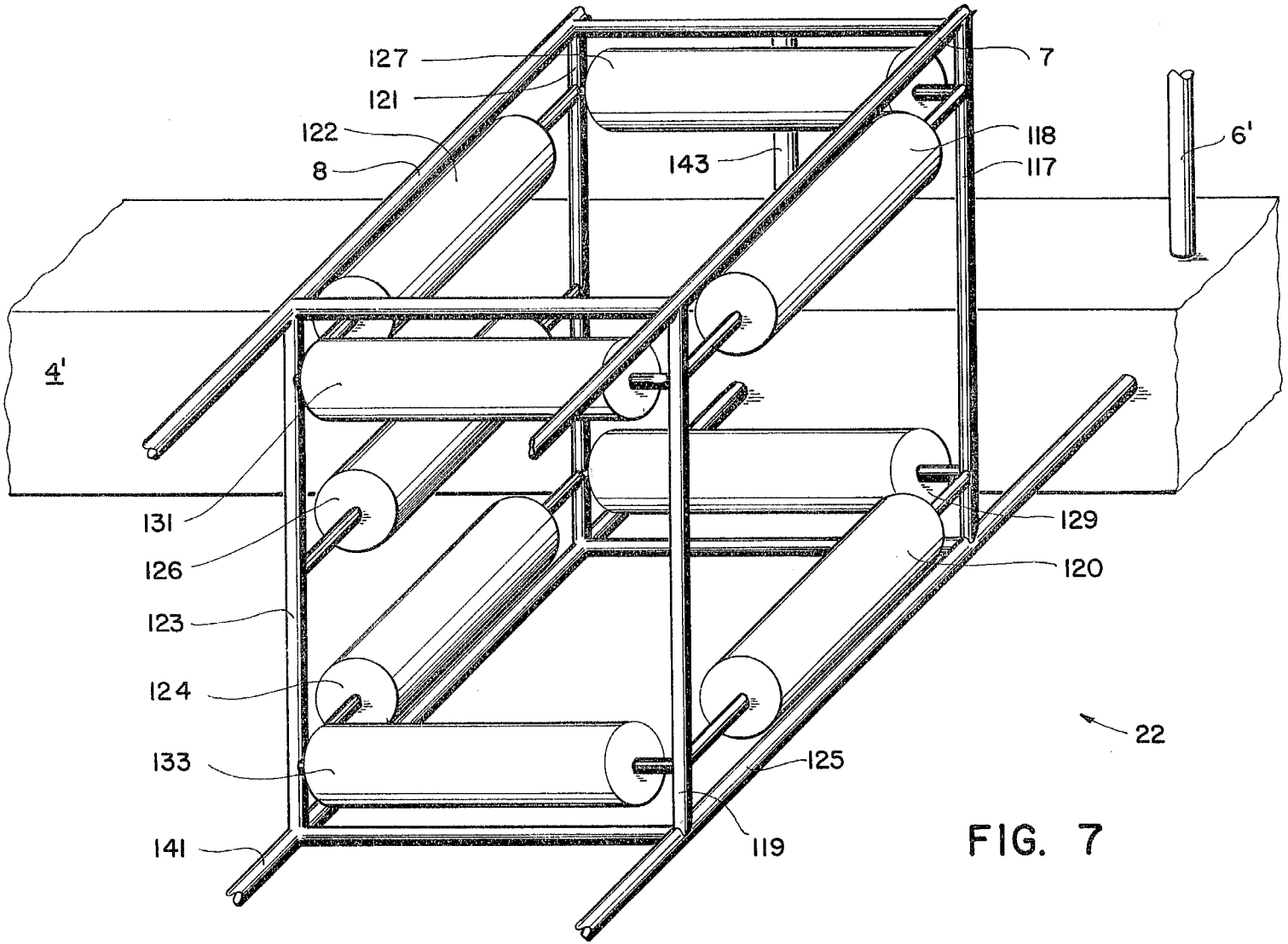
FIG. 7 shows an isometric view of the boom mounting means 22 for the vessel.
Figure 8C:
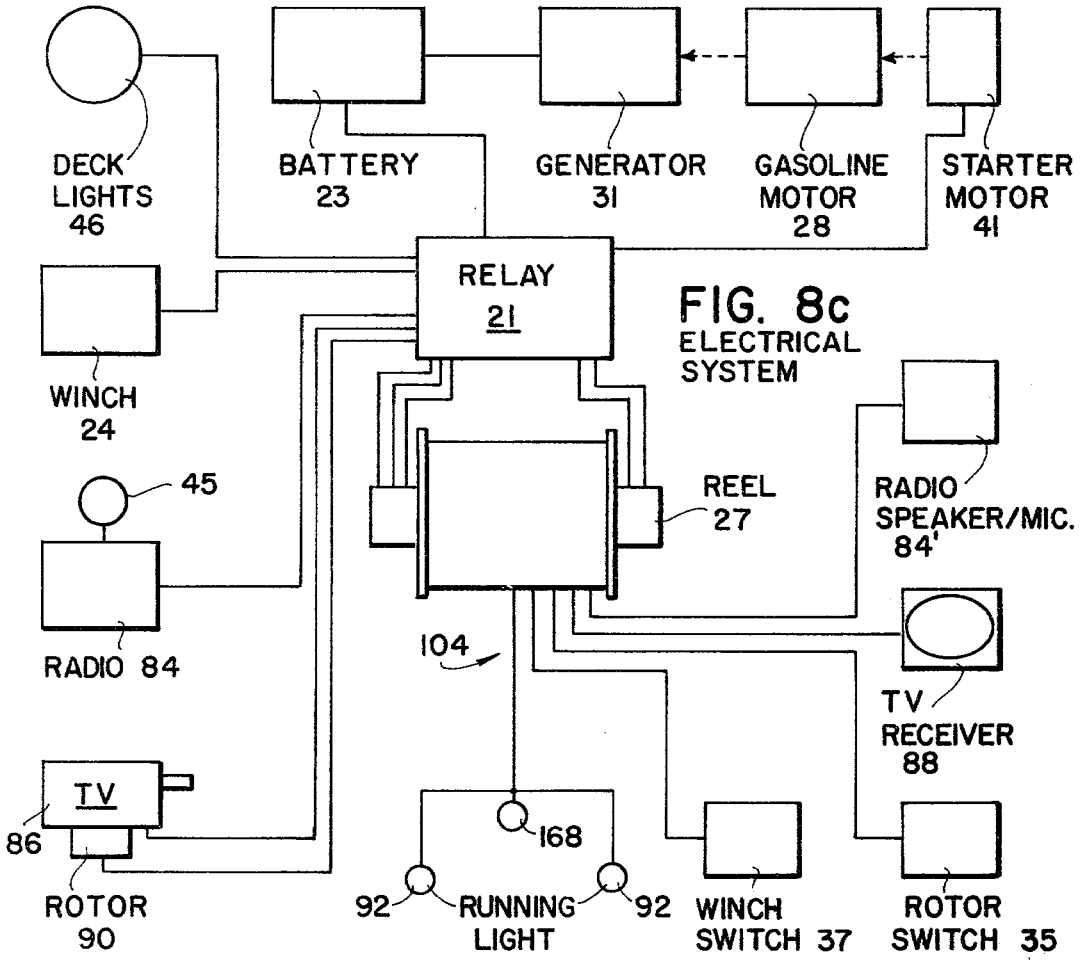
FIG. 8*c* is a schematic diagram of the electrical system for the craft.

The mounting assembly 22 shown in FIG. 7 consists of a parallelpiped frame mounted to the upper crossbars 7 and 8 and lower crossbars 125 and 141 and within which are rotatably mounted an array of horizontal rubber rollers. Crossbars 7 and 8 are supported on pontoon 4' by vertical bars 6' and 143, respectively, and are supported in a similar manner on pontoon 4 by vertical bar 6. The assembly is also stabilized by the side bars 137 and 139. Forward and backward stresses of the boom 20 on the vessel 2 are transferred by means of the forward upward roller 118 and forward lower roller 120 which are mounted between the vertical bars 119 and 117 mounted to the crossbars 7 and 125 and the rearward upper roller 122, the rearward middle roller 126 and the rearward lower roller 124 mounted between the vertical pipes 21 and 123 which are in turn mounted to the rear crossbars 8 and 141. Sideway stresses between the chair 30 and the vessel 2 are transferred by means of the right side upper roller 131 and the right side lower roller 133 mounted between the vertical pipes 119 and 123 and the left side upper roller 127 and the left side lower roller 129 which are mounted between the vertical pipes 117 and 121.

Each of the U-shaped beams 94, 96 and 98 shown in FIG. 6*a* have perforations 136 in the bottom and sides of the U-shape so as to reduce fluid drag forces and to reduce weight. A resilient bumper 144 is mounted on the top 146 on the outer most beam 94, for stopping the downward motion of the outer beam 94.

The air delivery system diagram shown in FIG. 8*d* includes an anti-return check valve 154 which is operatively connected in the air hose 116, to prevent the inadvertent loss of the breathing gas in the chair cavity 72 if the gas supply from the air compresser 114 fails.

A remote control for the propulsion and steering apparatus is shown in FIG. 8*a*. The propulsion motor can be a 4-cycle outboard motor 16 which is controlled by means of the control lines 19 to the relay block 21. Steering is controlled by means of the rack and pinion 15 driven by the electric servo-motor 17 from the relay block 21. The battery 23 provides power to the fuse panel and power block 21. Control lines from the relay block 21 go to the tension reel 27 on which the propulsion and steering control wires 104 are wound. The wires 104 are kept in tension by the reel 27 and pass down the boom 20 as previously described, and connect with the control console 32 shown in FIG. 8*b*. The switch handle 142 on the control console 32 enables the driver to remotely control forward and reverse motion by forward and reverse actuation of the control switch 142 and port and starboard motion by the sideways actuation of the switch handle 142.

FIG. 8*d* shows the air delivery and electrical charging system schematic diagram. A five horse power gasoline engine 28 drives a shaft 29 which in turn drives the 12 volt alternator 31 which charges the battery 23. The shaft 29 also drives the air compresser 114 which provides the air supply to the chair cavity 72 through the air hose 116. The air hose 116 is connected through the anti-return check valve 154 to the air compresser 114 on one end, and is rolled upon the air hose constant tension reel 33. The air hose 116 is played off the reel 33 at a constant tension and is drawn over the roller 122 of the mounting assembly 22 and through the slot 112 of the beam 94, as previously described.

FIG. 8*c* is an electrical schematic diagram of the balance of the electrical system excluding the electric controls for the propulsion and steering, previously shown in FIG. 8*a*. Power from the battery 23, charged by the alternator 31, is delivered to the relay block 21. The winch 24 is connected to the winch switch 37 on the chair 30 through the relay 21 and through the constant tension reel 27, upon which is rolled the control wire 104, which plays off the reel 27 to the boom 20, as previously described. Several controls are available on the control console 32 on the diving chair 30, in addition to the navigation control handle 142 and winch switch 37. The rotor switch 35 is connected through the relay 21 to the T.V. rotor 90. The T.V. receiver 88 can be connected through the relay 21 to the T.V. camera 86 and the radio speaker and microphone 84' may be connected through the relay 21 to the radio transmitting unit 84 and the antenna 45. Power for the dome light 168 and the chair diving lights 92 is supplied by means of a wire connected through the reel 27 to the relay 21. The deck running lights 46 and starter motor 41 on the vessel 2 are directly connected to the relay 21.

An alternate embodiment for the diving chair is shown in FIG. 9 wherein the concave canopy 162 mounted to the chair 160 has a closed upper portion 164 for containing the breathable gas ambient and the opened lower portion 166 for admitting the head of the seated diver. In this manner, the diver can breathe the breathable gas ambient while seated in the submerged diving chair. The simplified embodiment of the chair is less expensive to manufacture but offers fewer features than can be made available with the hinged canopy embodiment shown in FIGS. 1 through 5*a–c*.

The underwater cruise device described herein provides many advantages to the sport and commercial diver. Divers can cruise to a general dive site area with the dive chair suspended above the surface of the water. The roof 11 on the vessel 2 protects the divers while surface cruising. Divers may step from the pontoons on the vessel into the chair seat without having to enter the water. After having been seated, the divers lower and lock the air canopy, as well as the shark cage, if a shark cage is to be used. The control console mounted in the center of the chair seat provides access for either one of the pair of divers who can be accommodated by the chair shell, to precisely control depth direction and speed of the craft. Upon descent, divers are immersed up to their upper chest with the upper shoulder area and head enveloped in an air ambient provided by the upper cavity 72. The canopy 50, which is constructed of high quality aircraft, clear plastic, is distortion free and enables the divers to maneuver the craft and explore over great ranges without consuming their scuba air reserve or exhausting their energies.

Although the divers may have scuba gear on, they do not have to wear their diving face mask or breathe air from their scuba equipment, until such time as they may desire to leave the diving chair to engage in free diving. Having descended into the water, the divers can cruise at will, from a surface depth down to a depth of approximately 33 feet in the preferred embodiment, conversing with each other or with others on deck or in other such craft or surface craft through the use of a VHF or CB radio which is provided in the air canopy. The remote controlled, rotor mounted closed-circuit T.V. camera 86, provides a 360° view of surface conditions through an in-canopy mounted, 4-inch black and white T.V.

receiver, enabling the divers to monitor water craft traffic and weather conditions.

Upon arriving at a desirable dive site, the divers may stop the craft, lower and secure the anchor, and put on their diving face masks and scuba mouthpiece and then exit the diving chair. For the first time since entering the water, they will be using the scuba tank gear and will begin to exert themselves. Up to this time, they have been cruising underwater with a minimum degree of physical discomfort, effort or danger.

The diving chair disclosed herein enables divers to enter and exit the water in a controlled manner, being able to determine diving conditions such as dangerous sea life in the diving area, without engaging in the dangerous, conventional entry procedure of falling backwards off the boat into the water. The use of the diving chair also eliminates dangling legs and arms when the divers are attempting to climb onto a conventional, surface diving boat. The controlled descent which is provided by the disclosed diving chair also enables the divers to slowly equalize the pressure built up in the divers' sinuses and inner ear in a more positive and safer environment. It also allows time to control the buoyancy of any buoyancy vest worn by the diver and the proper adjustment of face masks and other equipment prior to leaving the diving chair.

The diving chair disclosed herein provides locomotion for the diver which greatly exceeds that of a free diving scuba diver who, conventionally, has a maximum range of a few hundred yards at 35 feet depth. In addition, the conventional diver is confronted with a rapid consumption of his scuba air supply and a rapid onset of fatigue whereas, by use of the diving chair disclosed herein, the diver's range is extended literally to miles and his scuba air useage is reduced to virtually zero until he desires to free dive.

The diving chair provides an air oasis that is suspended 33 feet down from the surface of the water and serves as a sanctuary in the event that the diver faces a critical situation such as a scuba malfunction, injury, dangerous fish, or excessive fatigue. The chair can also be used as a decompression station by divers who have spent time at depth greater than approximately 35 feet and must engage in decompression procedures before surfacing. In a typical decompression process, a diver must hang in midwater, grasping a rope, at sequentially decreasing depths of 30 feet, 20 feet and 10 feet levels for as long as 10 to 15 minutes at each depth, presenting an air supply and physical fatigue problem. By using the diving chair disclosed herein, these problems are obviated since the diver can sit in the chair for the prescribed amount of time and then gradually raise himself out of the water by use of his remote control, as previously described.

The diving chair disclosed herein, accomodates two divers simultaneously, provides a rendezvous for free divers to communicate under the canopy about dive conditions, diver physical and mental conditions, and serves as a diver sanctuary from dangerous conditions.

Although specific embodiments of the invention have been described, it will be understood by those workers having skill in the art that minor changes can be made to the structure, materials and areas of application of these specific embodiments without departing from the spirit and scope of the invention.

What is claimed is:

1. In an underwater cruise device including, a vessel floating on the surface of a body of water, a vertical boom slidably mounted to said vessel, a boom driving means connected between said vessel and said boom for selectively extending said boom vertically into said water, and a chair means mounted to said vertical boom for selective submersion of a diver seated thereon, in response to the operation of control means mounted to said chair means and operatively connected to said boom driving means, the improvement comprising:

a concave canopy mounted to said chair means having a closed upper portion for containing a breathable gas ambient and an open lower portion for admitting the head of said seated diver;

whereby said diver can breathe said breathable gas ambient while seated in said submerged chair.

2. The apparatus of claim 1, which further comprises:

a source of breathable gas mounted in proximity to the interior of said canopy;

said vessel including propulsion and steering apparatus mounted thereon.

3. The apparatus of claim 2, wherein said vertical boom further comprises:

a telescoping plurality of nested, U-shaped beams, with the outermost one of said beams slidably engaging a boom mounting means on said vessel and the innermost one of said beams mounted to said chair means and connected by means of a cable to said boom driving means.

4. The apparatus of claim 3, which further comprises:

said boom driving means being mounted on said vessel;

said control means on said chair being connected to said boom driving means via control wires; and said control wires and said cable passing axially through said innermost one of said beams from the bottom thereof and passing transversely through the open portion of said U-shape for said outermost beam, proximate to said mounting means on said vessel.

5. The apparatus of claim 4, which further comprises:

said control means on said chair being further connected to said propulsion and steering apparatus on said vessel by means of navigation control wires passing axially through said innermost one of said beams from the bottom thereof and passing transversely through the open portion of said U-shape for said outermost beam, proximate to said mounting means on said vessel.

6. The apparatus of claim 5, which further comprises:

said source of breathable gas in said canopy being connected to a breathable gas supply means on said vessel by means of an air hose passing axially through said innermost one of said beams from the bottom thereof and passing transversely through the open portion of said U-shape for said outermost beam, proximate to said mounting means on said vessel.

7. The apparatus of claim 5, wherein said control means further comprises:

magnetically actuated electric switches connected to said control wires and navigation wires, which are hermetically sealed and are actuated by the proximity of a ferromagnetic material mounted to an operating switch handle.

8. The apparatus of claim 3, wherein said boom mounting means further comprises:

a forward, upper roller rotatably mounted to said vessel, adjacent to said outermost beam;

a forward, lower roller rotatably mounted to said vessel, adjacent to said outermost beam;

a rearward, upper roller rotatably mounted to said vessel, adjacent to said outermost beam;

a rearward, lower roller rotatably mounted to said vessel, adjacent to said outermost beam.

9. The apparatus of claim 8, wherein said boom mounting means further comprises:

a right side, upper roller rotatably mounted to said vessel, adjacent to said outermost beam;

a right side, lower roller rotatably mounted to said vessel, adjacent to said outermost beam;

a left side, upper roller rotatably mounted to said vessel, adjacent to said outermost beam;

a left side, lower roller rotatably mounted to said vessel, adjacent to said outermost beam.

10. The apparatus of claim 9, which further comprises:

said vessel being a catamaran having first and second longitudinal pontoons;

a first crossbar and a second crossbar, each connecting said first and second pontoons, for supporting said boom mounting means between said pontoons.

11. The apparatus of claim 3, wherein each of said U-shaped beams have perforations in the bottom and sides of the U-shape to reduce fluid drag forces and reduce weight.

12. In an underwater cruise device including, a vessel floating on the surface of a body of water, a vertical boom slidably mounted to said vessel, a boom driving means connected between said vessel and said boom for selectively extending said boom vertically into said water, and a chair means mounted to said vertical boom for selective submersion of a diver seated thereon, in response to the operation of control means mounted to said chair means and operatively connected to said boom driving means, the improvement comprising:

said chair means comprising a concave shell with a closed rearward side and an open forward side having a lower interior surface for supporting said seated diver and an upper peripheral edge;

a concave canopy comprising a concave, transparent shell with a closed forward side and an open rearward side having an upper peripheral edge hingedly mounted to said upper peripheral edge of said chair means for sealable engagement therewith and a lower peripheral edge spaced above said lower interior surface of said chair means forming a diver access opening;

said canopy and said chair means forming an enclosed upper cavity for containing a breathable gas ambient above said diver access opening, surrounding the head of said seated diver;

whereby said diver can breathe said breathable gas ambient while seated in said submerged chair.

13. The apparatus of claim 12, which further comprises:

a source of breathable gas mounted in proximity to said enclosed upper cavity;

said vessel including propulsion and steering apparatus mounted thereon.

14. The apparatus of claim 13, wherein said chair means further comprises:

said closed rearward side of said chair having perforations through a lower portion thereof to reduce fluid drag forces.

15. The apparatus of claim 13, wherein said chair means further comprises:

latching means mounted to said chair and to said canopy to secure said canopy against said chair in said sealable engagement.

16. The apparatus of claim 13, wherein said chair means further comprises:

an arm rest means mounted to said chair, for supporting said control means.

17. The apparatus of claim 13, wherein said chair means further comprises:

radio communication means mounted on said chair means for communication with radio transceivers located above the water surface.

18. The apparatus of claim 13, which further comprises:

a television camera mounted on said vessel;

a television monitor mounted within said cavity of said chair means, operatively connected to said camera;

means mounted to said camera and connected to said control means, for controlling the orientation of said camera.

19. The apparatus of claim 13, wherein said chair means further comprises:

diving lights mounted to said chair.

20. The apparatus of claim 13, wherein said vertical boom further comprises:

a telescoping plurality of nested, U-shaped beams, with the outermost one of said beams slidably engaging a boom mounting means on said vessel and the innermost one of said beams mounted to said chair means and connected by means of a cable to said boom driving means.

21. The apparatus of claim 20, wherein the bottom of said closed rearward side of said chair means is mounted to the bottom of said innermost beam;

whereby the bottom of said chair means can be withdrawn completely above the surface of the water.

22. The apparatus of claim 21, which further comprises:

said boom driving means being mounted on said vessel;

said control means on said chair being connected to said boom driving means via control wires; and said control wires and said cable passing axially through said innermost one of said beams from the bottom thereof and passing transversely through the open portion of said U-shape for said outermost beam, proximate to said mounting means on said vessel.

23. The apparatus of claim 22, which further comprises:

said control means on said chair being further connected to said propulsion and steering apparatus on said vessel by means of navigation control wires passing axially through said innermost one of said beams from the bottom thereof and passing transversely through the open portion of said U-shape for said outermost beam, proximate to said mounting means on said vessel.

24. The apparatus of claim 23, which further comprises:

said source of breathable gas in said canopy being connected to a breathable gas supply means on said vessel by means of an air hose passing axially through said innermost one of said beams from the bottom thereof and passing transversely through the open portion of said U-shape for said outermost beam, proximate to said mounting means on said vessel.

25. The apparatus of claim 24, which further comprises:

an anti-return check valve operatively connected in said air hose, to prevent loss of said breathing gas in said chair cavity if said gas supply means fails.

26. The apparatus of claim 23, wherein said control means further comprises:

magnetically actuated electric switches connected to said control wires and navigation wires, which are hermetically sealed and are actuated by the proximity of a ferromagnetic material mounted to an operating switch handle.

27. The apparatus of claim 20, wherein said boom mounting means further comprises:

a forward, upper roller rotatably mounted to said vessel, adjacent to said outermost beam;

a forward, lower roller rotatably mounted to said vessel, adjacent to said outermost beam;

a rearward, upper roller rotatably mounted to said vessel, adjacent to said outermost beam;

a rearward, lower roller rotatably mounted to said vessel, adjacent to said outermost beam.

28. The apparatus of claim 27, wherein said boom mounting means further comprises:

a right side, upper roller rotatably mounted to said vessel, adjacent to said outermost beam;

a right side, lower roller rotatably mounted to said vessel, adjacent to said outermost beam;

a left side, upper roller rotatably mounted to said vessel, adjacent to said outermost beam;

a left side, lower roller rotatably mounted to said vessel, adjacent to said outermost beam.

29. The apparatus of claim 28, which further comprises:

said vessel being a catamaran having first and second longitudinal pontoons;

a first crossbar and a second crossbar, each connecting said first and second pontoons, for supporting said boom mounting means between said pontoons.

30. The apparatus of claim 20, wherein each of said U-shaped beams have perforations in the bottom and sides of the U-shape to reduce fluid drag forces and reduce weight.

31. The apparatus of claim 20, which further comprises:

a resilient bumper mounted on the top of said outermost beam, for stopping the downward motion of said beams.

32. The apparatus of claim 13, which further comprises:

an anchor means mounted to said chair.

33. The apparatus of claim 13, which further comprises:

a shark cage mounted to said chair.

34. The apparatus of claim 13, wherein said chair means further comprises:

a rear window mounted in the upper portion of said closed rearward side of said chair.

35. The apparatus of claim 13, which further comprises:

a resilient seal mounted between said chair and said canopy to improve said sealable engagement thereof.

36. The apparatus of claim 13, which further comprises:

a ballast weight mounted to said chair.

37. The apparatus of claim 13, which further comprises:

a reserve breathable gas tank mounted to said chair.

38. The apparatus of claim 13, which further comprises:

a resilient bumper mounted to the top of said chair for supporting said canopy in its open position.

* * * * *